US006961044B2

(12) United States Patent
Woo

(10) Patent No.: US 6,961,044 B2
(45) Date of Patent: Nov. 1, 2005

(54) APPARATUS AND METHOD FOR REDUCING POWER CONSUMPTION OF LCD BACKLIGHT LAMP

(75) Inventor: Jong Hyun Woo, Pyungtaek (KR)

(73) Assignee: LG Electronics Inc., Seoul (KR)

( * ) Notice: Subject to any disclaimer, the term of this patent is extended or adjusted under 35 U.S.C. 154(b) by 213 days.

(21) Appl. No.: 09/972,876

(22) Filed: Oct. 10, 2001

(65) Prior Publication Data

US 2002/0041280 A1 Apr. 11, 2002

(30) Foreign Application Priority Data

Oct. 10, 2000 (KR) ..... 2000-59491

(51) Int. Cl.[7] ..... G09G 3/36; G09G 5/00

(52) U.S. Cl. ..... 345/102; 345/87; 345/211

(58) Field of Search ..... 345/87, 95, 96, 345/98, 102, 204, 690, 210, 211, 212, 63, 84; 315/150, 151, 153, 154, 158

(56) References Cited

U.S. PATENT DOCUMENTS 5,272,327 A * 12/1993 Mitchell et al. ..... 250/205
5,786,801 A * 7/1998 Ichise ..... 345/102
5,996,082 A * 11/1999 Cortopassi ..... 713/321
6,252,355 B1 * 6/2001 Meldrum et al. ..... 315/150
6,404,145 B1 * 6/2002 Saito ..... 315/307

FOREIGN PATENT DOCUMENTS

JP 2000-035564 2/2000

* cited by examiner

*Primary Examiner*—Vijay Shankar
(74) *Attorney, Agent, or Firm*—Fleshner & Kim, LLP

(57) ABSTRACT

A apparatus and a method for reducing power consumption of a LCD (Liquid Crystal Display) backlight lamp includes a power unit supplying power, a control unit being supplied power from the power unit and outputting a brightness control information signal by incremental levels, a key input unit having adjustment keys for adjusting a brightness of a LCD screen, a memory unit storing a control information signal inputted from the control unit, an inverter unit being inputted the brightness control information signal by levels from the control unit and outputting power of a backlight lamp by corresponding incremental levels, and a backlight lamp being driven by the power output from the inverter unit. The apparatus and method are capable of reducing unnecessary power consumption by increasing the power to drive the backlight lamp gradually so as to be similar to an actual brightness increase curve of a backlight lamp in the consideration of luminescent characteristics of the backlight lamp and then supplying a constant preset power level after finishing a starting operation of the backlight lamp.

17 Claims, 3 Drawing Sheets

APPARATUS AND METHOD FOR REDUCING POWER CONSUMPTION OF LCD BACKLIGHT LAMP

BACKGROUND OF THE INVENTION

1. Field of the Invention

The present invention relates to an apparatus and a method for reducing power consumption of a LCD (Liquid Crystal Display) backlight lamp, and in particular to an apparatus and a method for reducing power consumption of a LCD (Liquid Crystal Display) backlight lamp which is capable of reducing unnecessary power consumption by supplying power from an inverter to a LCD backlight lamp so as to be similar to luminescent characteristics of a LCD backlight lamp.

2. Description of the Prior Art

Generally, a LCD (Liquid Crystal Display) is made up of elements known as pixels for displaying a figure or an image, by injecting liquid crystals between two glass plates, applying power to electrodes installed at the two glass plates and thereby varying the molecular arrangement of the liquid crystals at each pixel location.

However, a LCD (Liquid Crystal Display) panel does not radiate light in itself but transmits light from a backlight installed at a back surface of the panel as a light source, and the backlight lamp is installed in order to display contents more accurately and vividly. In order to operate the backlight lamp, a certain power input condition has to be satisfied, for example, in a monitor having a LCD display apparatus of not greater than 14.1", an AC voltage of 500~700V (40~70 Khz) and current of 1~7 mA have to be supplied to the backlight lamp.

The backlight lamp is operated by an inverter, and in order to satisfy the above-mentioned input condition, the operation of the inverter has to be controlled. In more detail, the luminescence of the backlight lamp is adjusted by varying the backlight lamp current outputted from the inverter, so that the brightness degree of the backlight lamp becomes greater in proportion to the size of the current supplied to the backlight lamp.

A method for operating the backlight lamp in accordance with the prior art will be described as below.

In order to vary the brightness of a backlight lamp, a brightness variation key is provided in a keyboard of a notebook computer, and a microprocessor reads set variation key value information, transmits a brightness adjustment information signal converted into information required for the brightness adjustment to an inverter, and the inverter controls the brightness of the backlight lamp by generating a backlight lamp current in accordance with the brightness adjustment information signal.

For example, by using a voltage level range of 0~5V, the microprocessor sets the brightness adjustment information signal for a minimum brightness at a value of 0V and sets the brightness adjustment information signal for a maximum brightness at a value of 5V. In addition, a variable quantity between discrete brightness levels is set as 0.5V. Herein, when the value for the first level is 0V, a minimum brightness value is 0V in a first level, and according to the increase by each level increment the backlight lamp becomes brighter, so that when an eleventh level is 5V, the maximum brightness value is 5V in the eleventh level. Herein, when the operation (driving) current of the backlight lamp is variable between 2~6 mA and the inverter is designed so as to be variable by levels of 0.5 mA, the first level value is 0V (corresponding to 2 mA), the second level value is 0.5V (corresponding to 2.5 mA), the eleventh level is 5V (corresponding to 6 mA).

In addition, when a user sets the backlight lamp for the maximum brightness, power is off or the backlight lamp is turned off by entering into a suspend mode by a display setting, the microprocessor stores the brightness adjustment information at the time in a memory. Afterwards, when the user turns on the backlight lamp again, the microprocessor reads again the brightness adjustment information stored in the memory or reads brightness adjustment information (example: 8 level) set as a default setting and transmits a brightness adjustment information signal to the inverter, and the inverter controls the brightness of the backlight lamp by generating a backlight lamp current corresponding to the brightness adjustment information signal.

The operation will be described in more detail. As depicted in FIG. 1, when a user sets the backlight lamp as a tenth level (4.5V) brightness in a total of eleven levels, the user turns off the backlight lamp and turns on again the backlight lamp as shown at steps S1, S2, and the microprocessor reads a brightness adjustment information signal (4.5V) stored in a memory and outputs it to the inverter as shown at step S3.

Herein, the inverter outputs a backlight lamp current (5.5 mA) corresponding to the tenth level (4.5V) to the backlight lamp as shown at steps S4, S5. However, the backlight lamp does not instantly output light at a brightness corresponding to the input current (5.5 mA), because of the luminescent characteristics of the backlight lamp, but the brightness of the backlight lamp increases slowly and is outputted as a stable state only after the power supplied to the backlight reaches to 5.5 mA after a certain time passage.

Herein, the luminescent characteristics of the backlight lamp can be different according to its thickness, length, kinds of enclosed gas of the lamp, the luminescent characteristics of the LCD lamp used for a general note PC are stabilized only after about 30 minutes have passed after the first lighting. In addition, the luminescent characteristics are sensitive to the temperature, and in a low temperature condition the rate of increase of the brightness is slower.

Accordingly, a LCD manufacturer defines a measurement reference time point of the brightness as "30 minutes after first lighting". According to the luminescent characteristics of the backlight lamp, the backlight lamp gradually radiates from the early lighting time point and only radiates fully after a certain time. In more detail, the inverter transmits an output corresponding to a tenth level (herein, 5.5 mA) to the backlight lamp and consumes power corresponding to the output level(herein, 5 Watts); however the backlight lamp shows a full brightness only after 30 minutes due to the characteristics of the backlight lamp.

Accordingly, as depicted in FIG. 2, the inverter continuously consumes 5 Watts from the early lighting in order to output the 5.5 mA driving current, but the brightness of the backlight lamp is actually less than 4 Watts from the early lighting to 10 minutes, 4.5 Watts after 20 minutes from the early lighting, and 5 Watts after 30 minutes from the early lighting.

In more detail, in the method for controlling the backlight lamp in accordance with the prior art, in supply of power to a backlight lamp through an inverter, lots of power is consumed unnecessarily in an early lighting by not considering the luminescent characteristics of the backlight lamp.

SUMMARY OF THE INVENTION

Accordingly, it is an object of the present invention to provide an apparatus and a method for reducing power consumption of a LCD (Liquid Crystal Display) backlight lamp which is capable of reducing unnecessary power consumption in consideration of the luminescent characteristics of a backlight lamp by gradually increasing power supply to the lamp similarly to an actual brightness increase curve of the backlight lamp and fixing a quantity of power supplied only after finishing a starting of the backlight lamp In order to achieve the object of the present invention, an apparatus for reducing power consumption of a LCD (Liquid Crystal Display) backlight lamp includes a power unit 10 supplying power, a control unit 40 being supplied power from the power unit 10 and outputting a brightness control information signal by incremental levels, a key input unit 30 having adjustment keys for adjusting a brightness of a LCD screen, a memory unit 20 storing a control information signal inputted from the control unit 40, an inverter unit 50 being inputted the brightness control information signal by incremental levels from the control unit 40 and outputting power to a backlight lamp by corresponding levels, and a backlight lamp 60 being inputted power from the inverter unit 50.

In order to achieve the above-mentioned object, a method for controlling a LCD (Liquid Crystal Display) lamp in accordance with the present invention includes outputting a brightness control signal corresponding to a brightness information value to an inverter while variously increasing a brightness information value over a certain time period in consideration of luminescent characteristics of a backlight lamp, and outputting fixedly a brightness control signal level corresponding to the brightness information value after the time period has lapsed.

DETAILED DESCRIPTION OF THE PREFERRED EMBODIMENT

Figure 1:
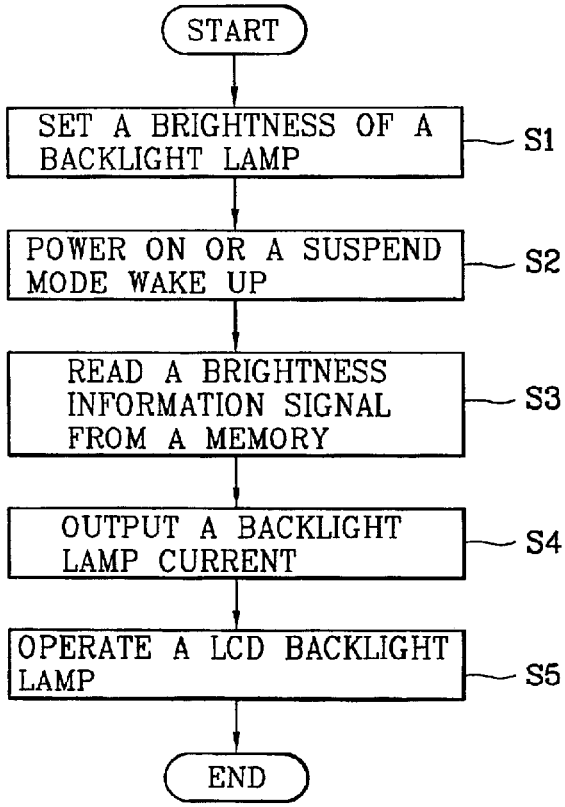
FIG. 1 CONVENTIONAL ART
FIG. 1 is a flow chart illustrating a method for controlling a brightness of a general LCD (Liquid Crystal Display) backlight lamp.
Figure 2:
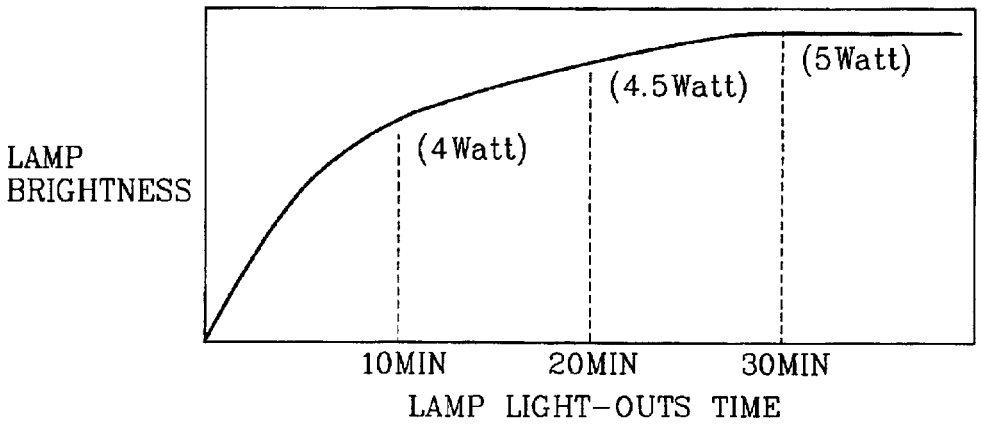
FIG. 2 CONVENTIONAL ART
FIG. 2 is a graph illustrating a lamp brightness curve according to LCD backlight lamp characteristics.
Figure 3:
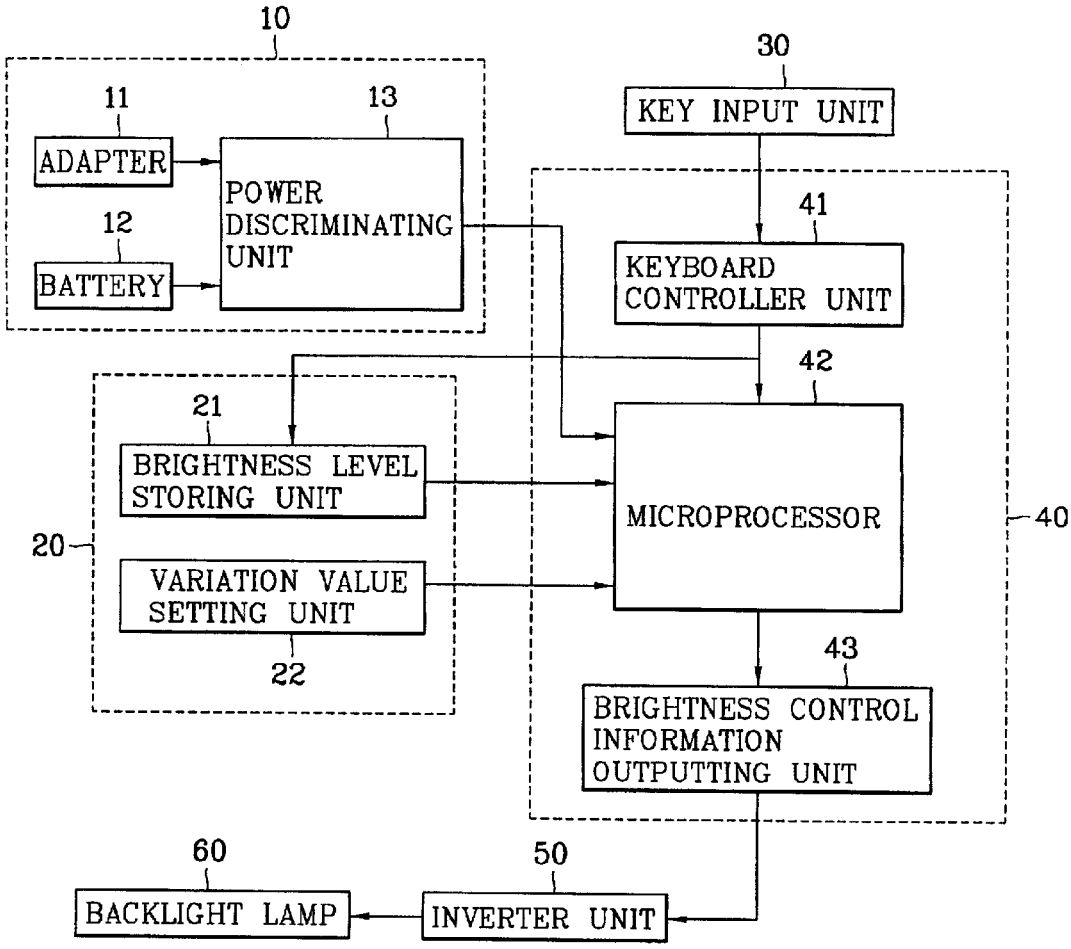
FIG. 3 is a block diagram illustrating an apparatus for reducing power consumption of a LCD backlight lamp in accordance with the present invention.

FIG. 3 is a block diagram illustrating an apparatus for saving power of a LCD (Liquid Crystal Display) backlight lamp in accordance with the present invention.

As depicted in FIG. 3, an apparatus for reducing power consumption of a LCD (Liquid Crystal Display) backlight lamp in accordance with the present invention includes a power unit 10 supplying power, a control unit 40 being supplied power from the power unit 10 and outputting a brightness control information signal by incremental levels, a key input unit 30 having adjustment keys for adjusting a brightness level of a LCD screen, a memory unit 20 storing a control information signal inputted from the control unit 40, an inverter unit 50 being inputted the brightness control information signal by incremental levels from the control unit 40 and outputting power to drive a backlight lamp by corresponding levels, and a backlight lamp 60 being supplied power from the inverter unit 50.

Herein, the power unit 10 uses a power adapter 11 or a battery 12, and the apparatus for reducing power consumption of the LCD (Liquid Crystal Display) backlight lamp further includes a power discrimination unit 13 for discriminating the power source of the power unit 10. The memory unit 20 is constructed with a brightness level storing memory 21 storing last brightness information before dimming (turning-off) of a LCD lamp as inputted from the control unit 40 and a variation value setting unit 22 setting a brightness variation quantity by incremental levels and a variation time by incremental levels. The control unit 40 includes a keyboard controller 41 recognizing a key press state by a user from the key input unit 30 and outputting a brightness adjustment input signal, a microprocessor 42 being inputted the brightness adjustment key input signal, selecting kinds of brightness adjustment information and brightness ROM table and outputting a brightness adjustment information signal, and a brightness adjustment information outputting unit 43 outputting the brightness adjustment information signal inputted from the microprocessor 42 to the inverter unit 50.

The operation of the apparatus for reducing power consumption of the LCD (Liquid Crystal Display) backlight lamp in accordance with the present invention will be described as below.

A notebook computer uses utility power through an adapter 11 or power of a battery 12, and the power discriminating unit 13 discriminates whether the input power source is power from the adapter or power from the battery and outputs a discrimination signal to the microprocessor 42. When a user presses the brightness adjustment key in order to adjust the brightness of the LCD screen using the key input unit 30, the keyboard controller 41 checks the adjustment and outputs a brightness information signal corresponding to a pertinent brightness level to the microprocessor 42. When the microprocessor 42 reads a user-set brightness information signal, selects kinds of brightness adjustment information and brightness ROM table, stores it in the memory unit 20 and outputs a brightness adjustment information signal, the inverter 50 generates driving power for the backlight lamp according to the brightness adjustment information signal outputted from the microprocessor 42 and operates the backlight lamp.

Herein, the microprocessor 42 is able to control the incrementing of the brightness information signal linearly or nonlinearly so as to be similar to the brightness increase curve of the lamp by composing the data in the brightness ROM table according to the luminescent characteristics of the backlight lamp, and the variation value setting unit 22 sets the brightness variation quantity by incremental levels or variation time by incremental levels corresponding to the brightness information stored in the memory.

Figure 4:
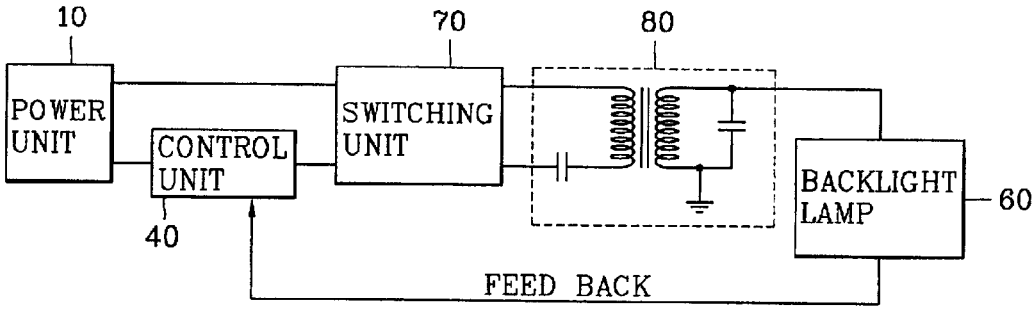
FIG. 4 is a block diagram illustrating an apparatus for reducing power consumption of a LCD backlight lamp having a control unit and outputting a brightness control information signal in accordance with the present invention.

FIG. 4 is a block diagram illustrating an apparatus for reducing power consumption of a LCD backlight lamp including a control unit outputting a brightness adjustment information signal in accordance with the present invention. As depicted in FIG. 4, the control unit outputs a brightness adjustment information signal such as a voltage level from a D/A port, a PWM signal or a SM BUS (System Management Bus) signal, and a switching unit 70 and transformer 80 performs a high speed switching of a direct current (9V~17V) inputted from the power unit in accordance with the brightness adjustment information signal supplied from the control unit 40 in order to convert it into an alternating current having a pulse format to drive the backlight lamp 60.

Figure 5:
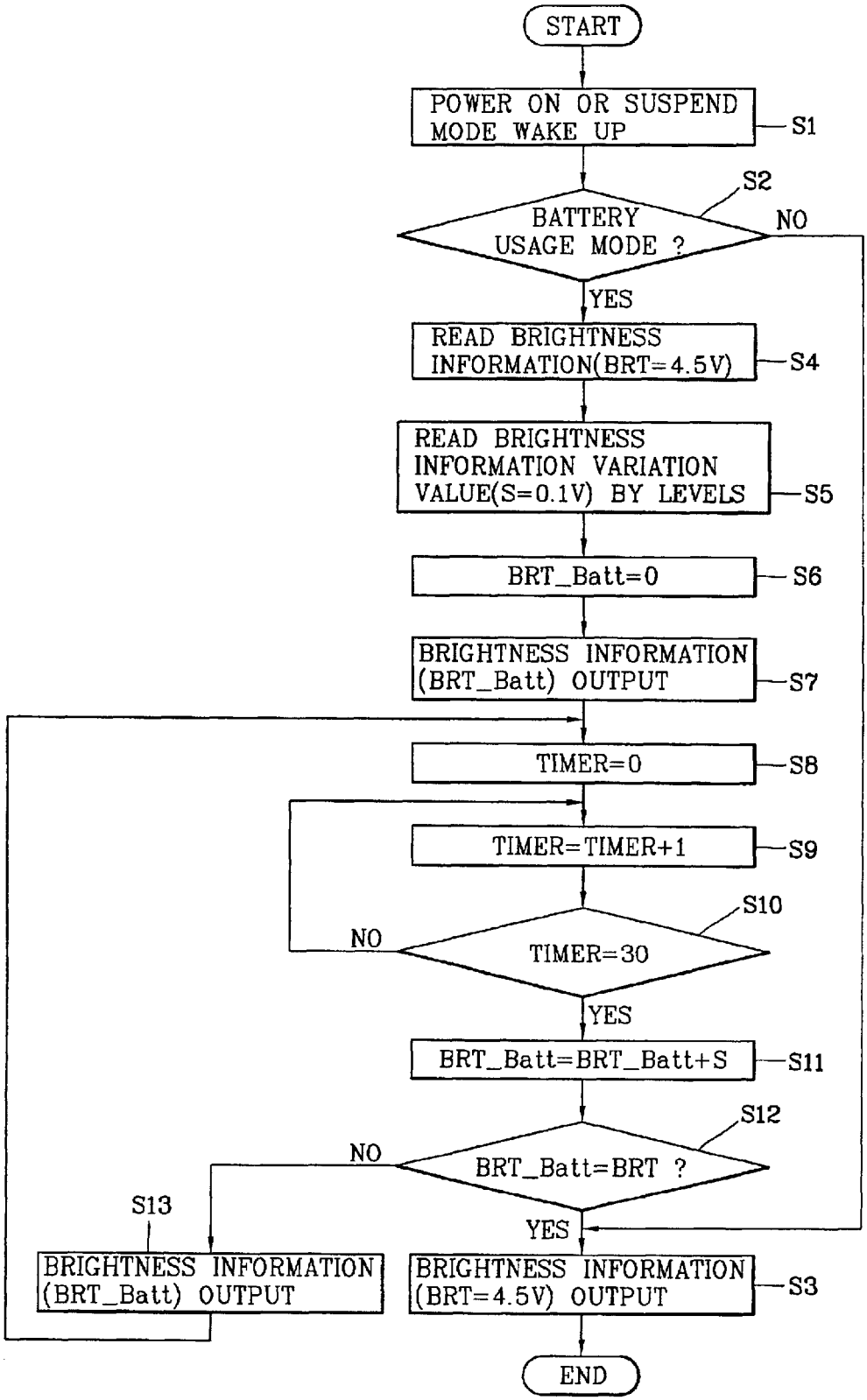
FIG. 5 is a flow chart illustrating a method for reducing power consumption of a LCD backlight lamp in accordance with the present invention.

FIG. 5 is a flow chart illustrating a method for reducing power consumption of a LCD backlight lamp. For example, when there are 11 discrete levels of brightness and a backlight lamp brightness is set at the 10th level by the user, the process for controlling the brightness of the backlight lamp is as described below.

When the notebook computer is turned on or a wake-up operation has accurred from a suspend mode, the microprocessor 42 checks the present power source from the power discriminating unit 13, and when it is checked as a power adapter 11, a control signal corresponding to the 10th brightness level information (BRT: 4.5V) is outputted to the brightness adjustment information outputting unit 43 as shown at steps S1~S3.

However, when the power discriminating unit 13 checks the present power source and the present power source is confirmed as the battery 12, the set brightness level information (BRT: 4.5V) is read from the memory unit 20, and by considering the luminescent characteristics of the backlight lamp, a driving current is gradually increased over a certain time period (example: 30 seconds) in order not to waste power, and a control signal corresponding to the set brightness level information (BRT: 4.5V) is fixedly outputted after a certain time point.

For example, when the user sets a brightness level variation value at the variation value setting unit 22, a brightness level information increment value is set to 0.1V, and a variation time is set as 30 seconds (TIMER=30), whereupon the microprocessor 42 outputs a control signal on the basis of the thusly set brightness level information variation value and the thusly set variation time. In more detail, in the first incremental level the brightness information value (BRT_Batt) is maintained at 0V for 30 seconds, in the second level the brightness level information value (BRT_Batt) is maintained as 0.1V for 30 seconds, and 10 step of brightness information (BRT_Batt=BRT=4.5V) the same as in the above-described method are outputted. Herein, the brightness adjustment information outputting unit 43 outputs the digital brightness adjustment information signal converted into information required for the brightness adjustment to the inverter unit 50.

Accordingly, an increase curve of current supplied from the inverter unit 50 to the backlight lamp is similar to an increase curve of brightness of a backlight lamp operated by the brightness information signal of 4.5V in the early startup operation, because the power consumption of the inverter gradually increases (from 2 W→2.2 W→2.4 W, . . . , 5 W), so it is possible to prevent unnecessary power consumption without disturbing the brightness of the LCD.

Herein, the digital brightness adjustment information signal uses a voltage level of a D/A port, a PWM duty cycle signal, or a SM bus signal. In addition, the adapter power 11 is gradually increased over a certain time period the same as the battery power 12 according to the user's setting, and when the adapter power reaches to a certain point, a control signal corresponding to the set brightness information (BRT: 4.5V) can be fixedly outputted.

As described above, the apparatus and method for reducing power consumption of the LCD backlight lamp are capable of reducing unnecessary power consumption by gradually increasing power supplied to drive the backlight lamp so as to be similar to an actual brightness increase curve of a backlight lamp in the consideration of the luminescent characteristics of the backlight lamp and then supplying required power fixedly after finishing a starting operation.

What is claimed is:

1. An apparatus for reducing power consumption of a backlight lamp in a LCD (Liquid Crystal Display), comprising:

a power unit configured to supply power;

a control unit configured to receive power supplied from the power unit and output a brightness control information signal;

an inverter unit configured to receive the brightness control information signal from the control unit and output driving power for driving a backlight lamp; and a backlight lamp configured to receive the power from the inverter unit, wherein when the LCD is turned on or a wake up operation is activated after a suspend mode, the control unit is configured to control the brightness adjustment information signal so as to be related to a brightness increase curve of the backlight lamp such that power supplied to the backlight lamp is gradually increased over time, and wherein the brightness control information signal output by the control unit comprises one of a plurality of discrete incremental level values corresponding to discrete brightness levels, and the inverter unit outputs power to the backlight lamp at a level corresponding to the required brightness level.

2. The apparatus of claim 1, further comprising;

a memory unit configured to store control information for adjusting a brightness of a screen of a LCD.

3. The apparatus of claim 1, further comprising:

a key input unit configured to receive input from a user for adjusting a brightness of a LCD screen.

4. The apparatus of claim 1, wherein the control unit includes:

a keyboard controller unit configured to discriminate a key press state by a user and output a brightness adjustment key input signal;

a microprocessor configured to receive the brightness adjustment key input signal and select a kind of brightness adjustment information and a brightness ROM table, and output brightness control information;

a brightness adjustment information outputting unit configured to receive the brightness control information from the microprocessor and output the brightness control information signal to the inverter unit.

5. The apparatus of claim 4, wherein the brightness adjustment information outputting unit outputs a digital brightness control information signal to the inverter unit.

6. The apparatus of claim 5, wherein the digital brightness control information signal includes a voltage level of a D/A port, a PWM duty cycle signal, or a SM BUS (System Management Bus) signal.

7. The apparatus of claim 2, wherein the memory unit is further configured to store control information including a last brightness control information signal output by the control unit and the memory unit further comprises an incremental brightness variation value setting unit configured to output a preset brightness value to the control unit.

8. The apparatus of claim 7, wherein the incremental brightness variation value setting unit sets a brightness variation value by incremental level or a variation time by incremental level according to an input by a user.

9. The apparatus of claim 1, wherein the power unit uses a power adapter or a battery as a power source and further comprises a power discrimination unit configured to discriminate between the power sources.

10. A method for saving power of a backlight lamp in a LCD (Liquid Crystal Display), comprising:

outputting a brightness control information signal to an inverter unit corresponding to a brightness information value, wherein when the LCD is turned on or a wake up operation is activated after a suspend mode, the brightness information value gradually increases over a predetermined time period in consideration of luminescent characteristics of a backlight lamp such that power supplied to the backlight lamp is gradually increased over time; and outputting a constant brightness information control signal corresponding to the brightness information value after the gradually increased brightness information value reaches a preset value, wherein the brightness control information signal output to the inverter unit comprises one of a plurality of discrete incremental level values corresponding to discrete brightness levels, and the inverter unit outputs power to the backlight lamp at a level corresponding to the required brightness level.

11. The method of claim 10, wherein the luminescent characteristics vary according to one or more of a thickness, length, kind of enclosed gas, and environmental temperature of the backlight lamp.

12. The apparatus of claim 1, wherein the control unit controls the brightness control information signal by referring to a brightness ROM table configured based on luminescent characteristics of the backlight lamp.

13. The apparatus of claim 12, wherein the luminescent characteristics vary according to one or more of a thickness, length, kind of enclosed gas, and environmental temperature of the backlight lamp.

14. The apparatus of claim 2, wherein the control information includes the brightness control information signal.

15. The apparatus of claim 14, herein the control information further includes a brightness level information increment value and a variation time value.

16. The apparatus of claim 2, wherein the memory unit stores the control information when the backlight lamp is turned off or dimmed.

17. A LCD (Liquid Crystal Display) comprising the apparatus of claim 1.

* * * * *